US008245547B1

(12) United States Patent
Garthe

(10) Patent No.: US 8,245,547 B1
(45) Date of Patent: Aug. 21, 2012

(54) PADLOCK

(75) Inventor: Bernhard Garthe, Gevelsberg (DE)

(73) Assignee: ABUS August Bremicker Söhne KG, Wetter-Volmarstein (DE)

( * ) Notice: Subject to any disclaimer, the term of this patent is extended or adjusted under 35 U.S.C. 154(b) by 0 days.

(21) Appl. No.: 13/014,780

(22) Filed: Jan. 27, 2011

(51) Int. Cl.
*E05B 67/06* (2006.01)
*E05B 67/22* (2006.01)
*E05B 67/24* (2006.01)

(52) U.S. Cl. ..... 70/38 A; 70/451; 70/39; 70/367; 70/372; 70/369; 70/38 R; 70/371; 70/DIG. 62

(58) Field of Classification Search ..... 70/38 A, 70/451, 49, 46, 43, 39, 367, 372, 369, 44, 70/45, 42, 40, 41, 38 R, 48, 47, 373, 368 B, 70/38 C, 368, DIG. 62, 371, 38 B
See application file for complete search history.

(56) References Cited

U.S. PATENT DOCUMENTS

| | | | | |
|---|---|---|---|---|
| 1,714,423 | A * | 5/1929 | Jacobi | 70/368 |
| 2,094,604 | A | 10/1937 | Keil | |
| 2,141,748 | A | 12/1938 | Hansen | |
| 2,199,336 | A | 4/1940 | Fletcher | |
| 2,282,983 | A * | 5/1942 | Lach | 70/38 A |
| 3,068,682 | A * | 12/1962 | Russell et al. | 70/38 A |
| 3,172,279 | A | 3/1965 | Patriquin | |
| 3,793,856 | A | 2/1974 | Lippisch | |
| 4,966,021 | A * | 10/1990 | Boag | 70/383 |
| 5,704,234 | A * | 1/1998 | Resch | 70/371 |
| 5,931,030 | A * | 8/1999 | Chen | 70/38 A |
| 6,388,213 | B1 | 5/2002 | Letient et al. | |
| 6,425,274 | B1 | 7/2002 | Laitala et al. | |
| 6,574,999 | B2 * | 6/2003 | Chen | 70/33 |
| 7,148,435 | B2 | 12/2006 | Lau et al. | |
| 7,278,283 | B2 | 10/2007 | Meckbach | |
| 2006/0185404 | A1 * | 8/2006 | Hansen | 70/38 A |
| 2011/0094273 | A1 | 4/2011 | Uliano | |

FOREIGN PATENT DOCUMENTS

| | | | |
|---|---|---|---|
| DE | 31 26 035 | A1 | 7/1981 |
| DE | 83 33 943 | U1 | 11/1983 |
| DE | 34 21 754 | A1 | 6/1984 |
| DE | 43 23 693 | A1 | 7/1993 |

OTHER PUBLICATIONS

Translation of German Search Report relating to German Patent Application No. 10 2011 009 591.1 dated Jan. 9, 2012.
Search Report dated Apr. 25, 2012 relating to PCT/EP2012/000359.

* cited by examiner

*Primary Examiner* — Lloyd Gall
*Assistant Examiner* — David E Sosnowski
(74) *Attorney, Agent, or Firm* — Gifford, Krass, Sprinkle, Anderson & Citkowski, P.C.

(57) ABSTRACT

A padlock includes a lock housing, a U-shaped lock hoop and a lock cylinder in order selectively to lock the lock hoop to the lock housing, wherein the lock cylinder has a cylinder axis and is secured to the lock housing by means of a securing element. The securing element is displaceably supported at the lock cylinder and is resiliently supported transversely to the cylinder axis, wherein the securing element engages into a securing opening at an inner side of the lock housing to secure the lock cylinder to the lock housing.

10 Claims, 4 Drawing Sheets

PADLOCK

The invention relates to a padlock having a lock housing, a U-shaped lock hoop and a lock cylinder in order selectively to lock the lock hoop to the lock housing, wherein the lock cylinder has a cylinder axis and is secured to the lock housing by means of a securing element.

With such a padlock, the lock hoop is displaceably held at the lock housing. In an open position of the lock hoop, a free end of the lock hoop can, for example, be conducted through an eye of an object. In a closed position, both ends of the lock hoop are connected to the lock housing. In this locked position, the lock hoop can be locked to the lock housing via a locking device by means of the lock cylinder. For this purpose, the lock cylinder typically has a cylinder housing and a cylinder core which is rotatably supported with respect to the named cylinder axis in the cylinder housing and can be actuated by means of an associated key. The named locking device can, for example, include a rotational bolt which is rotationally fixedly coupled to the rotatable cylinder core as well as two blocking balls which can engage into or escape back out of locking recesses of the lock hoop in dependence on the rotational position of the rotational bolt.

The lock cylinder forms a separate unit which is secured to the lock housing by means of a securing element. It is known for this purpose from the U.S. Pat. No. 6,425,274 B1 to use a securing screw which is introduced through a hoop receiving passage parallel to the cylinder axis and is screwed to a web section of the cylinder housing. A disadvantage of this solution comprises the fact that, in order to fasten the lock cylinder to the lock housing, the securing screw first has to find its way into the associated threaded bore at the end of a hoop receiving passage and then has to be rotated by means of a tool.

It is an object of the invention to provide a padlock of the named kind in which the lock cylinder can be fastened to the lock housing in a simple manner. A releasable fastening of the lock cylinder at the lock housing should in particular also be possible and the padlock should be able to be produced in a compact size.

This object is satisfied by a padlock having the features of claim 1 and in particular in that the securing element is displaceably supported at the lock cylinder and is resiliently supported transversely to the cylinder axis, wherein the securing element engages into a securing opening at an inner side of the lock housing to secure the lock cylinder to the lock housing.

The securing element is thus not inserted into the lock cylinder parallel to the cylinder axis, but the securing element is rather movable transversely to the cylinder axis, in particular exactly perpendicular to the cylinder axis. In this respect, the securing element is resiliently supported at the lock cylinder, i.e. the securing element is pre-tensioned (for example, by means of a compression spring) in the direction of a securing position in which the securing element cooperates with a securing opening which is formed in the inner space of the lock housing. The lock cylinder is automatically secured to the lock housing by such an arrangement when the lock cylinder is inserted into the lock housing. The fastening of the lock cylinder to the lock housing can thus take place in a particularly comfortable and reliable manner, in particular without the necessity of using a tool.

A particular advantage of the securing element movable transversely to the securing element comprises the fact that a compact construction shape of the padlock can be achieved, for example with a width of the lock housing of at most 35 mm, for example, despite the separate formation of the lock cylinder (in particular secured releasably to the lock housing, cf. the following). It is in particular not necessary that the lock cylinder is arranged in alignment with the respective hoop receiving passage of the lock housing so that a securing screw can be screwed into the lock cylinder through the respective hoop receiving passage, such as is known from the aforesaid U.S. Pat. No. 6,425,274 B1. In addition, the lock hoop and the respective hoop receiving passage of the lock housing can have a small diameter since it is not necessary to adapt the diameter of the respective hoop receiving passage to the size of a securing screw in accordance with U.S. Pat. No. 6,425,274 B1. Such a securing screw must, however, have a specific minimum size to ensure a sufficient stability of the fastening of the lock cylinder to the lock housing.

In accordance with an advantageous embodiment, the lock housing has a reception opening for the lock cylinder which is preferably provided at the lower side of the lock housing. Whereas the securing element is initially urged back into the lock cylinder, the lock cylinder can be introduced along the cylinder axis into the reception opening of the lock housing such that, when an end position is reached, the securing element snaps into the securing opening to secure the lock cylinder to the lock housing in the end position. A particularly simple and secure fastening of the lock cylinder to the lock housing hereby takes place.

The securing element is preferably arranged at a web section of a cylinder housing of the lock cylinder, with this web section also including the tumblers of the lock cylinder (e.g. pin tumblers). The securing element is preferably formed independently of the tumblers of the lock cylinder and does not extend into the cylinder core of the lock cylinder.

It is furthermore preferred if the lock cylinder has a key introduction opening, wherein the securing element is arranged at an end of the lock cylinder (or of the named web section) remote from the key introduction opening. The lock cylinder can in particular have a plurality of tumblers (e.g. pin tumblers), wherein the securing element is arranged behind the last tumbler with respect to the direction of introduction of the key. At this point, the securing element is protected particularly well against manipulation to prevent an unauthorized removal of the lock cylinder from the lock housing.

In accordance with an advantageous embodiment, the securing element is formed by a securing pin which is pre-tensioned in the direction of a securing position by means of a compression spring. Alternatively to this, the securing element can, however, also be formed, for example, in one piece as a securing spring which is pre-tensioned in the direction of the securing position by its own elasticity.

The fastening of the lock cylinder to the lock housing is particularly comfortable when the securing element is captured in a non-losable manner at the lock cylinder. It is preferred in this respect if the securing element is displaceably supported in a reception recess of the lock cylinder (in particular of the named web section of the cylinder housing), wherein the securing element has an abutment section which cooperates with an abutment section of the lock cylinder to prevent the securing element from escaping from the reception recess. It is therefore hereby avoided that the resiliently supported securing element inadvertently falls out of the reception recess or is pushed out of it before the lock cylinder is inserted into the lock housing.

The named abutment section of the securing element is preferably formed by a diameter enlargement of the securing element, wherein the abutment section of the lock cylinder is formed by a corresponding diameter reduction of a peripheral boundary of the named reception recess. This can be realized, for example, in that the diameter reduction is formed by an abutment ring inserted into the reception recess of the lock cylinder.

It is desirable for some applications that the lock cylinder is releasably secured to the lock housing to be able to replace the lock cylinder later to be able to later change the locking secret of the lock cylinder. It is hereby possible that a preconfiguration takes place at the padlock manufacturer's, wherein a locksmith caries out a customized adaptation before delivery of the padlock to the end user (for example by combining a specific color of the lock housing with a specific locking secret). It can thus also be achieved that the user has to carry along a smaller number of different keys, as is explained in the initially named U.S. Pat. No. 6,425,274 B1.

It is preferred for such a releasable fastening of the lock cylinder to the lock housing if the lock housing has two hoop receiving passages for receiving a respective shank of the lock hoop, wherein the total securing opening for the securing element is accessible at the inner side of the lock housing via one of the two hoop receiving passages and is in particular formed by a part of one of the two hoop receiving passages. The respective hoop receiving passage is closed by means of the associated hoop shank when the lock hoop is locked at the lock housing. The securing element is thus not accessible in the locked position of the lock hoop. If, however, the lock hoop is unlocked, i.e. if the lock cylinder is brought into the release position by means of the associated key, the hoop shank can be removed from the respective hoop receiving passage so that the securing opening and the securing element are hereby accessible. The securing element can now be urged back into a release position in order selectively again to remove the lock cylinder from the lock housing. In this respect, there is a particular advantage in that a compact construction shape of the padlock is made possible, as explained above, despite the releasable securing of the lock cylinder to the lock housing.

To facilitate the engaging of a tool to urge back the securing element, the securing element can have an actuating chamfer, in particular at its free end. Such an actuation chamfer can e.g. be formed by a peripheral chamfer.

The named reception recess of the lock cylinder for the securing element can be a blind hole, i.e. the pre-tensioned securing element or a compression spring associated with the securing element is supported at a base of the reception recess.

Alternatively to this, a throughgoing reception passage for the securing element can be provided in the lock cylinder (in particular in the web section of a cylinder housing), with the following advantage being achieved: In some lock cylinders, it is desirable or necessary that a possible rotational movement of the cylinder core is limited relative to the cylinder housing. This can be achieved in a simple manner in that the securing element is displaceably supported in the cylinder housing and is radially outwardly pre-tensioned relative to the cylinder axis by means of a compression spring, wherein the compression spring is supported at a rotary abutment element which is likewise displaceably supported in the cylinder housing and is radially inwardly pre-tensioned with respect to the cylinder axis by means of the compressing spring. This rotary abutment element engages into a recess of the cylinder core which extends along a limited peripheral angle with respect to the cylinder axis. The rotational movement of the cylinder core relative to the cylinder housing is limited by this engagement. Unlike in the initially named U.S. Pat. No. 6,425,274 B1, a peripherally limited engagement recess is therefore thus provided on the part of the rotatable cylinder core, wherein the rotary abutment element engaging into this recess is provided in a reception passage on the part of the cylinder housing which is anyway required for the named securing element.

In accordance with a further advantageous embodiment, the lock housing is formed in one piece and of plastic. By using a lock housing of plastic, the padlock is suitable as a so-called lockout lock for securing a switch of an industrial plant such as is described in the U.S. Pat. No. 7,278,283 B2. Such a lockout lock prevents an inadvertent activation of the industrial plant while a service engineer is carrying out work on the plant and blocks a switch associated with the industrial plant in an OFF position in this period by means of the padlock. Since, in the padlock in accordance with the invention, the lock cylinder can be introduced in a straight line into the lock housing until the securing element automatically snaps into the securing opening of the lock housing, in contrast to the two-part embodiment in accordance with the U.S. Pat. No. 7,278,283 B2, the lock housing can be configured in one part, whereby the manufacture of the lock housing becomes less expensive.

A one-part embodiment of the lock housing also contributes to a compact construction shape. A compact construction shape of the padlock is particularly advantageous for the use as a lockout lock since a plurality of lockout locks are frequently fastened in direct proximity to one another at a switch cabinet or at a fuse box, as is shown, for example, in the U.S. Pat. No. 7,148,435 B2 and in the U.S. Pat. No. 6,388,213 B1.

The invention will be explained in the following only by way of example with reference to the drawings. Elements which are the same or of the same kind are marked by the same reference numerals therein.

Figure 1:
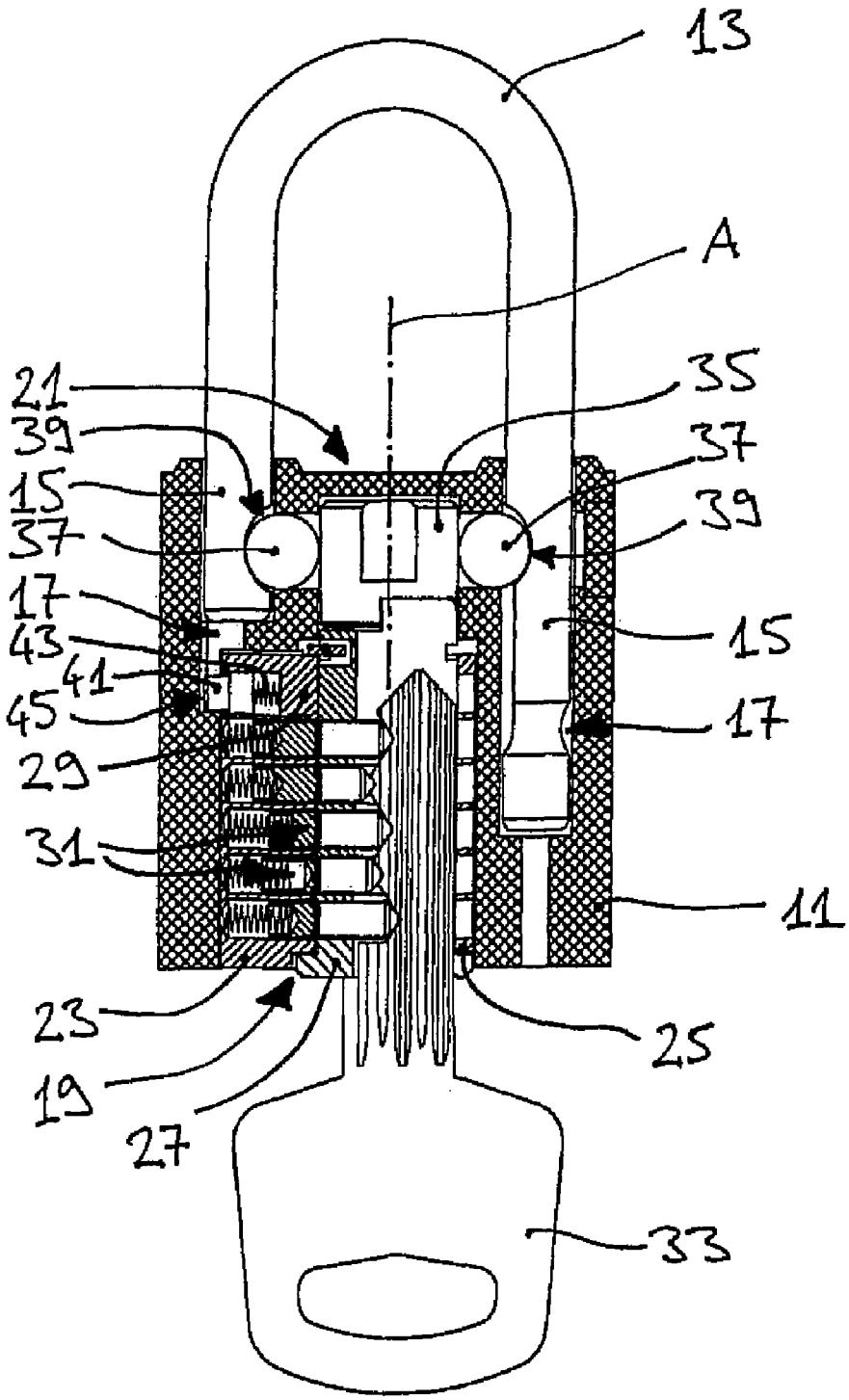
FIG. 1 shows a longitudinal view of a first embodiment of a padlock.

The padlock shown in FIG. 1 has a lock housing 11 and a U-shaped lock hoop 13 which is held displaceably in a straight line at the lock housing 11. The lock hoop 13 has two hoop shanks 15 which are received in a respective hoop receiving passage 17 of the lock housing 11.

The padlock furthermore comprises a lock cylinder 19 which selectively locks the lock hoop 13 to the lock housing via a locking device 21. The lock cylinder 19 has a cylinder housing 23 having a hollow cylindrical core reception section 25 in which a cylinder core 27 is rotatably supported about a cylinder axis A. The cylinder housing 23 furthermore has an eccentric web section 29 molded to the core reception section 25. In the web section 29 and in the core reception section 25, a plurality of pin tumblers 31 are arranged which cooperate with a key 33 which is introduced into the cylinder core 27.

The latching device 21 includes a rotational bolt 35 which is rotationally fixedly connected to the cylinder core 27 and two blocking balls 37 which are selectively urged by means of the rotational bolt 35 into a respective locking recess 39 of the two hoop shanks 15.

A securing element 41 which secures the lock cylinder 19 to the lock housing 11 is provided at the web section 29 of the cylinder housing 23, and indeed behind the pin tumblers 31 with respect to the introduction direction of the key 33. For this purpose, the securing element 41 is pre-tensioned in the direction of the securing position shown in FIG. 1 by means of a compression spring 43, and indeed radially outwardly with respect to the cylinder axis A. In this securing position, the securing element 41 engages into a securing opening 45 which is formed at the inner side of the lock housing 11 and forms an axial prolongation of one of the two hoop receiving passages 17, i.e. the securing opening 45 opens into the respective hoop receiving passage 17.

Figure 2:
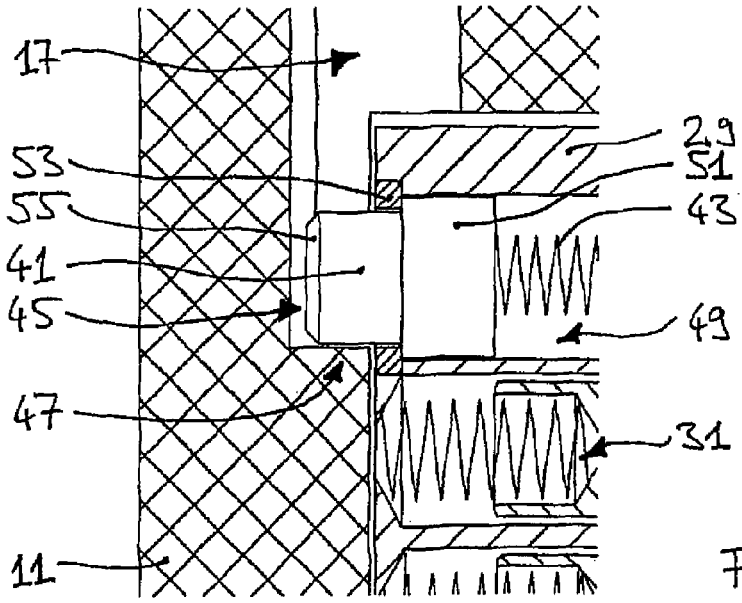
FIG. 2 shows a detail view of FIG. 1.

FIG. 2 shows the securing element 41 and its environment in a detail view. It can be recognized that the securing element 41 engages behind a step section 47 of the lock housing 11. The securing element 41 is displaceably supported in a reception recess 49 of the cylinder housing 23. The securing element 41 is in pin shape and has an axially effective abutment section in the form of a diameter enlargement 51. The diameter enlargement 51 cooperates with an abutment ring 53 which is inserted into the reception recess 49. It is hereby prevented that the securing element inadvertently escapes from the reception recess 49 despite the pre-tension force applied by the compression spring 43. It is further shown in FIG. 2 that the tip of the securing element 41 has a peripheral actuation chamber 55.

The lock cylinder 19 can be secured in a simple and reliable manner to the lock housing 11 by the securing element 41 which springs back transversely to the cylinder axis A, i.e. is pretensioned in the direction of the securing position. For this purpose, the lock cylinder 19 is introduced along the cylinder axis A into the lock housing 11 up to the reaching of the end position shown in FIG. 1, wherein the securing element 41 snaps into the securing opening 45 to secure the lock cylinder 19 at the lock housing 11. This kind of fastening does not require any tool.

A separate, closed securing opening 45 could generally be provided for the securing element 41. Since in the embodiment in accordance with FIG. 1 the securing opening 45, however, opens into the associated hoop receiving passage 17, the securing element 41 is accessible when the lock hoop 31 in the unlocked state of the lock cylinder 19 is brought into its open position in which the respective hoop shank 15 has been removed from the hoop receiving passage 17. The securing element 41 can then be urged completely back into the reception recess 49 while using a tool in order to allow the authorized user to remove the lock cylinder 19, for example, to change the lock secret. The actuation chamfer 55 at the tip of the securing element 41 in this respect facilitates a corresponding engagement at the securing element 41.

It must still be stressed that the padlock shown can be produced in a compact construction shape (FIG. 1 is an enlarged view). The lock housing 11 can in particular have a small width since the web section 29 of the cylinder housing 23 can have a small depth and it is not necessary that the web section 29 is arranged completely in alignment with the respective hoop receiving passage 17 of the lock housing 11, i.e. the web section 29 of the cylinder housing 23 only partly projects into the axial prolongation of the respective hoop receiving passage 17. The minimal width of the lock housing 11 is thus only fixed by the minimal dimensions of the lock cylinder 19 (diameter of the cylinder core 17, minimal depth of the web section 29 for the pin tumblers 31) and the minimal wall thickness in the lateral environment of the lock cylinder 19. In addition, the lock hoop 13 and the respective hoop receiving passage 17 of the lock housing 11 can have a small diameter since no loose securing element of a predetermined minimal size (in particular a securing screw) has to be introduced through the respective hoop receiving passage 17 into the lock housing 11. In the embodiment in accordance with FIGS. 1 and 2, the reception recess 49 for the securing element 41 is formed as a blind hole, wherein the compression spring 43 is supported at the base of the blind hole, i.e. at the cylinder housing 23.

FIGS. 3 to 6 in contrast show an alternative embodiment in which the compression spring 43 is supported at a rotary abutment element 61. The rotary abutment element 61 is likewise displaceably supported in the reception recess 49, wherein the rotary abutment element 61 is radially inwardly pre-tensioned with respect to the cylinder axis A and wherein the reception recess 49 is formed as a throughgoing bore. The rotary abutment element 61 engages into an engagement recess 63 which is formed at the outer jacket surface of the cylinder core 27 and serves as a guide groove for the rotary abutment element 61. The engagement recess 63 extends along a restricted peripheral angle with respect to the cylinder axis A (see FIG. 6). A rotary abutment similar to that which is known from the initially named U.S. Pat. No. 6,425,274 B1 (however, in a reverse arrangement) is hereby formed for the rotational movement of the cylinder core 27 relative to the cylinder housing 23.

The rotary abutment element 61 is formed in pin shape and has an axially effective abutment section in the form of a diameter enlargement 65 which cooperates with an abutment section of the cylinder housing 23 in the form of a restriction 67 to prevent an inadvertent escaping of the rotary abutment element 61 from the reception recess 49.

Figure 4:
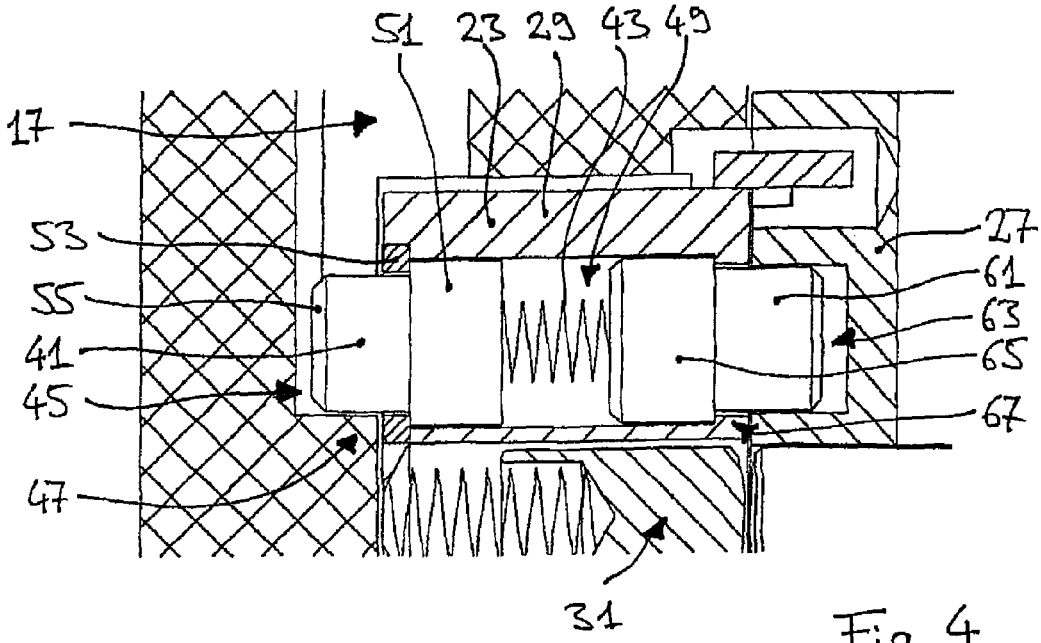
FIG. 4 shows a detail view of FIG. 3.
Figure 3:
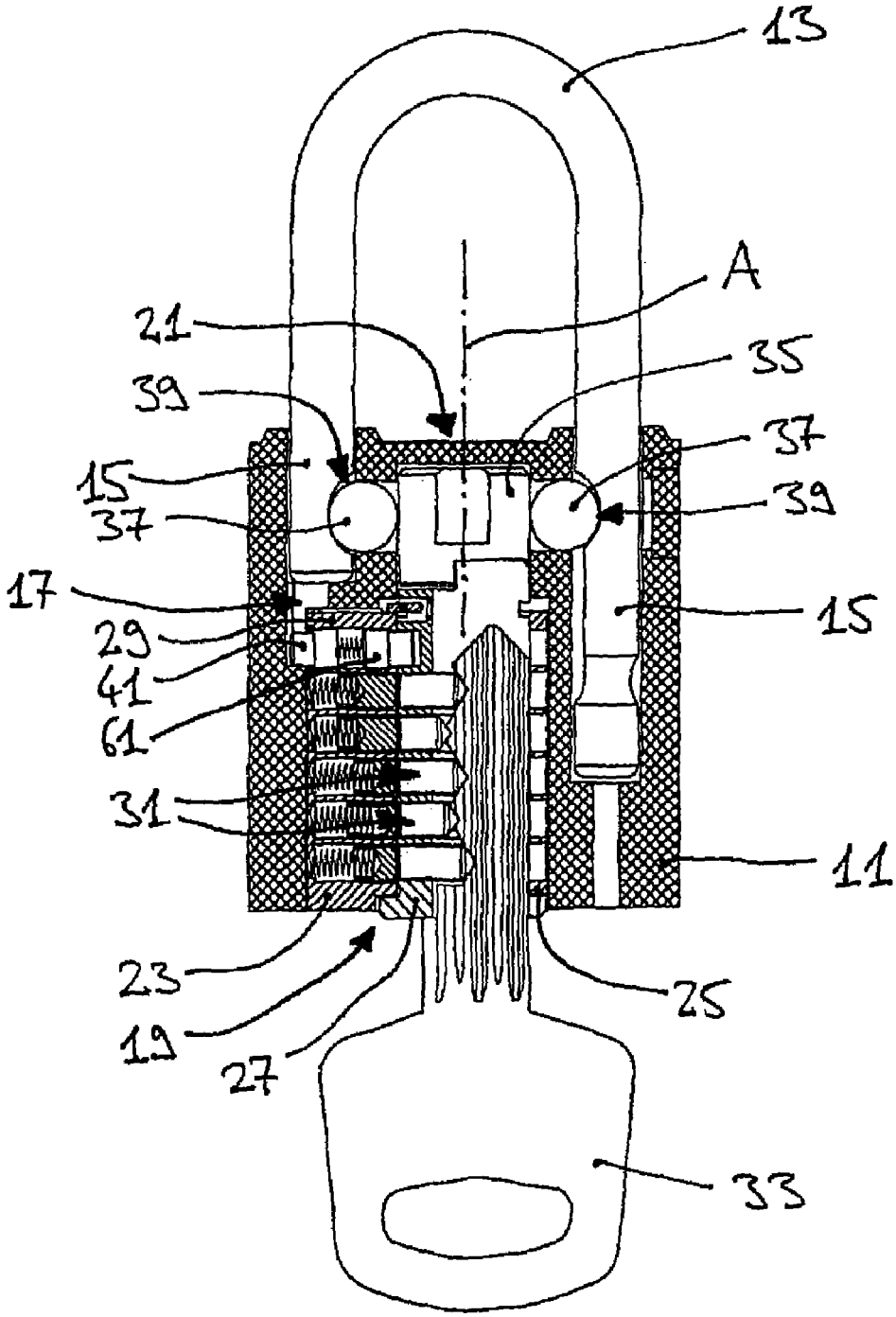
FIG. 3 shows a longitudinal view of a second embodiment of a padlock.
Figure 5:
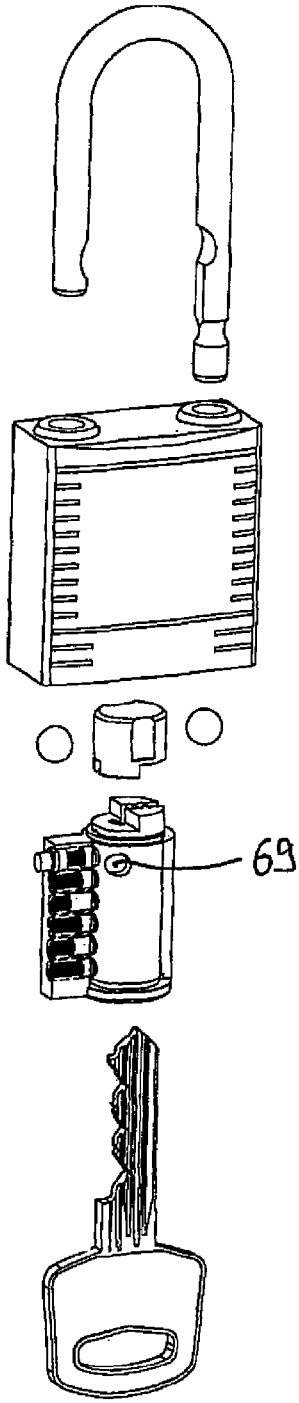
FIGS. 5 and 6 show a respective exploded view of the second embodiment in accordance with FIGS. 3 and 4.
Figure 6:
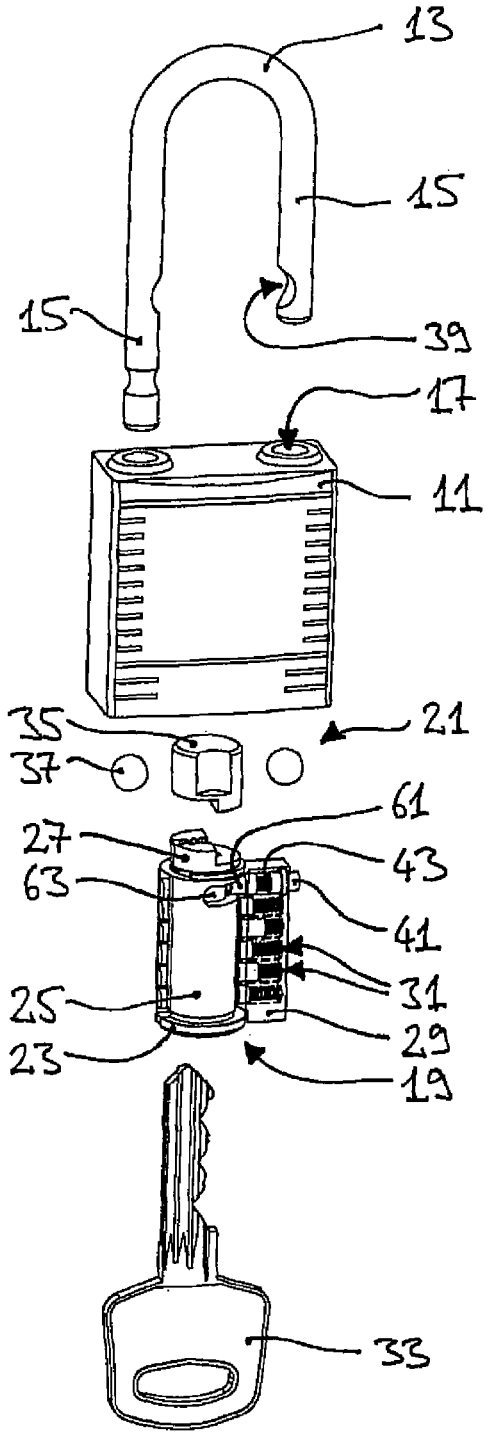

The explained rotary abutment can even selectively be overcome by the resilient support of the rotary abutment element 61 to be able to carry out a pin exchange of the lock cylinder 19, as is likewise known from the U.S. Pat. No. 6,425,27 B14. This purpose is served by the actuation opening 69 (FIG. 5) through which a tool can be introduced to engage at the tip of the rotary abutment element 61 and to urge it out of the engagement recess 63 (FIG. 4). The cylinder core 27 can then be brought into a rotational position in which the pin tumblers 31 can be replaced.

The lock housing 11 of the padlock shown in FIGS. 1 to 6 can be formed from plastic, whereby the padlock is particularly well suited as a lockout lock.

The invention claimed is:

1. A padlock having a lock housing, a U-shaped lock hoop and a lock cylinder in order selectively to lock the lock hoop to the lock housing, wherein the lock cylinder has a cylinder axis and is secured to the lock housing by means of a securing element, wherein the securing element is displaceably supported at the lock cylinder and is resiliently supported transversely to the cylinder axis, wherein the securing element engages into a securing opening at an inner side of the lock housing to secure the lock cylinder to the lock housing, wherein the lock cylinder has a cylinder housing and a cylinder core which is rotatably supported in the cylinder housing, wherein the securing element is displaceably supported in the cylinder housing and is radially outwardly pre-tensioned with respect to the cylinder axis by means of a compression spring, wherein the compression spring is supported at a rotary abutment element which is likewise displaceably supported in the cylinder housing and is radially inwardly pre-tensioned with respect to the cylinder axis by means of the compression spring, wherein the rotary abutment element engages into a recess of the cylinder core to limit a rotational movement of the cylinder core relative to the cylinder housing.

2. A padlock in accordance with claim 1, wherein the lock housing has a reception opening for the lock cylinder, wherein the lock cylinder can be introduced into the reception opening along the cylinder axis such that, when an end position is reached, the securing element snaps into the securing opening to secure the lock cylinder to the lock housing in the end position.

3. A padlock in accordance with claim 1, wherein the cylinder housing has a web section at which the securing element is supported.

4. A padlock in accordance with claim 1, wherein the lock cylinder has a key introduction opening, wherein the securing element is arranged at an end of the lock cylinder remote from the key introduction opening.

5. A padlock in accordance with claim 1, wherein the securing element is formed by a securing pin.

6. A padlock in accordance with claim 1, wherein the securing element is positioned in a reception recess of the cylinder housing, and wherein the securing element has an abutment section which cooperates with an abutment section of the cylinder housing to prevent the securing element from escaping from the reception recess.

7. A padlock in accordance with claim 6, wherein the abutment section of the securing element is formed by a diameter enlargement, and wherein the abutment section of the cylinder housing is formed by a diameter reduction of a peripheral boundary of the reception recess.

8. A padlock in accordance with claim 1, wherein the lock housing has two hoop reception passages for receiving a respective shank of the lock hoop, wherein the securing opening is accessible for the securing element via one of the hoop reception passages.

9. A padlock in accordance with claim 1, wherein the securing element has an actuation chamfer in order selectively to be able to urge the securing element into the lock cylinder.

10. A padlock in accordance with claim 1, wherein the lock housing is formed in one piece and from plastic.

* * * * *